US009373335B2

(12) United States Patent
Hooks et al.

(10) Patent No.: US 9,373,335 B2
(45) Date of Patent: Jun. 21, 2016

(54) PROCESSING AUDIO OBJECTS IN PRINCIPAL AND SUPPLEMENTARY ENCODED AUDIO SIGNALS

(71) Applicant: DOLBY LABORATORIES LICENSING CORPORATION, San Francisco, CA (US)

(72) Inventors: S. Spencer Hooks, San Mateo, CA (US); Freddie Sanchez, Berkeley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/423,388

(22) PCT Filed: Aug. 26, 2013

(86) PCT No.: PCT/US2013/056576

§ 371 (c)(1),
(2) Date: Feb. 23, 2015

(87) PCT Pub. No.: WO2014/035864

PCT Pub. Date: Mar. 6, 2014

(65) Prior Publication Data

US 2015/0228286 A1 Aug. 13, 2015

Related U.S. Application Data

(60) Provisional application No. 61/696,073, filed on Aug. 31, 2012.

(51) Int. Cl.
*G10L 19/008* (2013.01)
*H04H 20/89* (2008.01)

(Continued)

(52) U.S. Cl.
CPC ..... *G10L 19/008* (2013.01); *H04H 20/89* (2013.01); *H04H 60/04* (2013.01); *G10L 19/167* (2013.01);

(Continued)

(58) Field of Classification Search
USPC ..... 704/500–504; 375/253–366
See application file for complete search history.

(56) References Cited

U.S. PATENT DOCUMENTS 4,385,384 A * 5/1983 Rosbury et al. ..... 714/717
4,891,806 A * 1/1990 Farias et al. ..... 370/503

(Continued)

FOREIGN PATENT DOCUMENTS

EP 2490426 8/2012
RS 1332 U 8/2013

(Continued)

OTHER PUBLICATIONS

Engdegard, J. "MPEG Spatial Audio Object Coding—The ISO/MPEG Standard for Efficient Coding of Interactive Audio Scenes" AES presented at the 129th Convention, Nov. 4-7, 2010, San Francisco, CA USA.

(Continued)

*Primary Examiner* — Abul Azad

(57) ABSTRACT

Methods and apparatuses are disclosed that can combine audio content from two encoded input signals into a new encoded output signal without requiring a decode or re-encode of audio content in either encoded input signal. Encoded data representing audio content and spatial location of audio objects in two different input encoded signals are combined to generate an encoded output signal that has encoded data representing audio objects from both of the input encoded signals.

20 Claims, 3 Drawing Sheets

(51) Int. Cl.

| | |
|---|---|
| ***H04H 60/04*** | (2008.01) |
| *H04S 3/00* | (2006.01) |
| *G10L 19/16* | (2013.01) |
| *H04S 1/00* | (2006.01) |

(52) U.S. Cl.

CPC ..... *G10L 19/173* (2013.01); *H04S 1/005* (2013.01); *H04S 1/007* (2013.01); *H04S 3/004* (2013.01); *H04S 3/008* (2013.01); *H04S 2420/03* (2013.01)

(56) References Cited

U.S. PATENT DOCUMENTS

| | | | | |
|---|---|---|---|---|
| 5,751,773 | A * | 5/1998 | Campana, Jr. | 375/346 |
| 6,493,389 | B1 | 12/2002 | Bailleul | |
| 6,611,212 | B1 | 8/2003 | Craven | |
| 6,664,913 | B1 | 12/2003 | Craven | |
| 6,807,528 | B1 | 10/2004 | Truman | |
| 7,177,804 | B2 * | 2/2007 | Wang et al. | 704/219 |
| 8,078,301 | B2 | 12/2011 | Srinivasan | |
| 8,194,862 | B2 | 6/2012 | Herr | |
| 2008/0025182 | A1 * | 1/2008 | Seo et al. | 369/85 |
| 2008/0253440 | A1 | 10/2008 | Srinivasan | |
| 2009/0177479 | A1 | 7/2009 | Yoon | |
| 2009/0252355 | A1 * | 10/2009 | Mao | 381/309 |
| 2009/0326960 | A1 | 12/2009 | Breebaat | |
| 2010/0014692 | A1 | 1/2010 | Schreiner | |
| 2010/0021134 | A1 * | 1/2010 | Baek | 386/95 |
| 2010/0298960 | A1 | 11/2010 | Cho | |
| 2011/0002405 | A1 * | 1/2011 | Raveendran | 375/260 |
| 2011/0028215 | A1 | 2/2011 | Herr | |
| 2011/0112842 | A1 | 5/2011 | Seo | |
| 2013/0170646 | A1 | 7/2013 | Yoo | |

FOREIGN PATENT DOCUMENTS

| | | |
|---|---|---|
| WO | 2008/003362 | 1/2008 |
| WO | 2008/035275 | 3/2008 |
| WO | 2011/039195 | 4/2011 |

OTHER PUBLICATIONS

ATSC ATSC Standard: Digital Audio Compression (AC-3, E-AC-3), published on Mar. 23, 2012, A/52:2012, Washington, D.C.

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

Emmett, J. "Engineering Guidelines the EBU/AES Digital Audio Interface" Jan. 1, 1995.

SMPTE Journal, "Ancillary Data Packet and Space Formatting" SMPTE, Jul. 1995, No. 7, White Plains, NY, US.

* cited by examiner

PROCESSING AUDIO OBJECTS IN PRINCIPAL AND SUPPLEMENTARY ENCODED AUDIO SIGNALS

CROSS-REFERENCE TO RELATED APPLICATIONS

This application claims priority to U.S. Provisional Patent Application No. 61/696,073 filed 31 Aug. 2012, which is hereby incorporated by reference in its entirety.

TECHNICAL FIELD

The present invention pertains to audio coding and playback systems, and is directed toward improved methods and devices for processing encoded audio information.

BACKGROUND ART

Traditional channel-based digital audio coding systems mix all audio content such as dialogue, background music, and sound effects into one or more channels of information and encode those channels into a digital bitstream. This digital bitstream may be generated remotely and delivered to a user's playback system by broadcasting, point-to-point transmission on a network or recording onto a storage media for later retrieval, or may be generated locally for immediate rendering and playback such as by a video game. The audio content of each channel is intended to be reproduced by one or more loudspeakers during playback according to the number and arrangement of the loudspeakers in the playback environment.

After audio content is mixed and encoded into a digital bitstream by a channel-based digital audio coding system, removing audio elements or adding audio elements to the digital bitstream requires an additional decoding of the encoded bitstream, which requires additional computational resources and increases implementation costs of devices. For some systems, the decoded bitstream must be encoded again, which further increases implementation costs.

The additional complexity needed to add or remove audio elements is disadvantageous in audio playback systems incorporating devices such as Blu-ray players, broadcast set-top boxes and game consoles that provide additional or supplementary audio content intended to be played back with the principal audio content of an encoded digital bitstream. For example, some devices generate audible feedback for operations performed by a user to select playback options, play a video game or provide audio content associated with a picture shown within another picture. Some applications offer interactive or live audio content such as multi-player gaming applications that offer the ability for a player to "chat" with other remotely-located players during game play, or applications that generate audio alerts to notify a user of an event such as the arrival of a message.

Traditional channel-based audio playback systems cannot easily reproduce both the principal audio content and the supplementary audio content as described above because the traditional devices in these systems cannot easily combine their supplementary audio content with the principal audio content of an encoded digital bitstream that is being reproduced or played back by the audio system.

Another coding technique known as spatial audio object coding has been introduced within the past few years. Proposed audio object-based coding techniques promise some improvements over channel-based techniques but more improvement is still needed.

DISCLOSURE OF INVENTION

It is an object of the present invention to provide for a more efficient way to combine audio content from two encoded input signals into a new encoded output signal without requiring a decode or re-encode of audio content in either encoded input signal.

One way that this object can be achieved is by receiving a principal encoded signal that includes encoded data representing discrete audio content and spatial location for each of one or more principal audio objects, receiving a supplementary encoded signal that includes encoded data representing discrete audio content and spatial location for each of one or more supplementary audio objects, and assembling encoded data from the principal encoded signal with encoded data from the supplementary encoded signal to generate the encoded audio output signal with encoded data representing the discrete audio content and the spatial location for each of at least one of the principal audio objects and at least one of the supplementary audio objects. The encoded audio output signal may be transmitted, recorded or played back immediately using traditional distribution and playback systems.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Introduction

Figure 1:
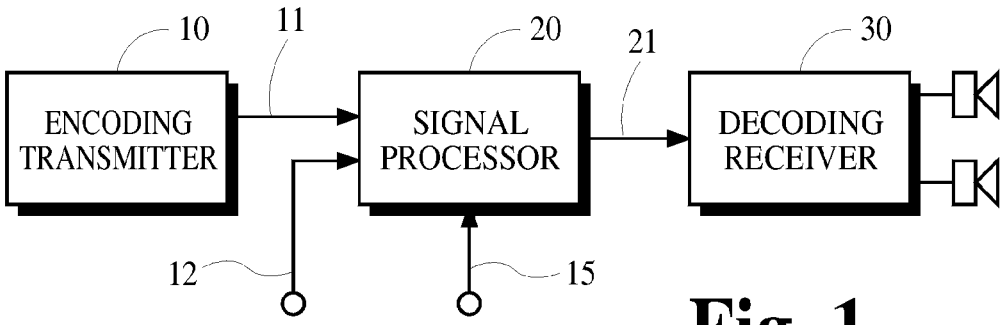
FIG. 1 is a schematic block diagram of an exemplary digital audio system that incorporates various aspects of the present invention.

FIG. 1 is a schematic block diagram of an exemplary digital audio system that incorporates various aspects of the present invention. The encoding transmitter 10 generates along the communication path 11 a principal encoded signal that includes encoded data representing discrete audio content and spatial location for each of one or more principal audio objects. The principal audio objects may be real-world sources of audio content such as musical instruments or vocal artists whose audio content is captured by microphones, or they may be synthesized audio elements whose content is generated by a computer or other type of audio signal generator. The communication path 11 may be any medium capable of conveying the principal encoded signal from the encoding transmitter 10 to one or more decoding receivers. For example, the communication path 11 may be a broadcast medium or a point-to-point transmission medium that conveys the principal encoded signal from the encoding transmitter 10 to one or more receivers, or it may be a storage medium that records the encoded signal for subsequent delivery to one or more decoding receivers.

In conventional audio systems, one or more decoding receivers such as the decoding receiver 30 shown in the figure receive the principal encoded signal directly from the encoding transmitter 10 and decode it to recover digital data representing the audio content and spatial location for principal audio objects. The decoding receiver 30 processes the digital data to generate audio signals along one or more audio channels that are connected to acoustical output transducers such as loudspeakers or headphones. Two acoustical output transducers are shown in the figure but one or more transducers may be used as desired. The audio signals that are generated along the audio channels are generated by the decoding receiver 30 in such a manner that the acoustical output transducers produce a soundfield that a listener may perceive as representing the audio content of the principal audio objects emanating from their respective spatial locations.

In a system that incorporates various aspects of the present invention, the signal processor 20 receives the principal encoded signal from the communication path 11, receives from the path 12 a supplementary encoded signal that includes encoded data representing discrete audio content and spatial location for each of one or more supplementary audio objects, and assembles encoded data from the principal encoded signal with encoded data from the supplementary encoded signal to generate along the path 21 an encoded audio output signal with encoded data representing the discrete audio content and the spatial location for each of at least one of the principal audio objects and at least one of the supplementary audio objects. The communication path 21 may be any medium capable of conveying the encoded output signal from the signal processor 20 to the decoding receiver 30 but the signal processing 20 may be used advantageously when the communication path 21 conveys the encoded output signal to the decoding receiver 30 for immediate processing and playback.

If desired, the signal processor 20 may adapt its operation in response to a control signal received from the communication path 15 as discussed below.

The present invention is directed toward the processing that is performed by the signal processor 20. Details of implementation for the encoding transmitter 10 and the decoding receiver 30 are not discussed further because these details are not needed to understand how to implement and carry out the present invention.

B. Signal Processor

Figure 2:
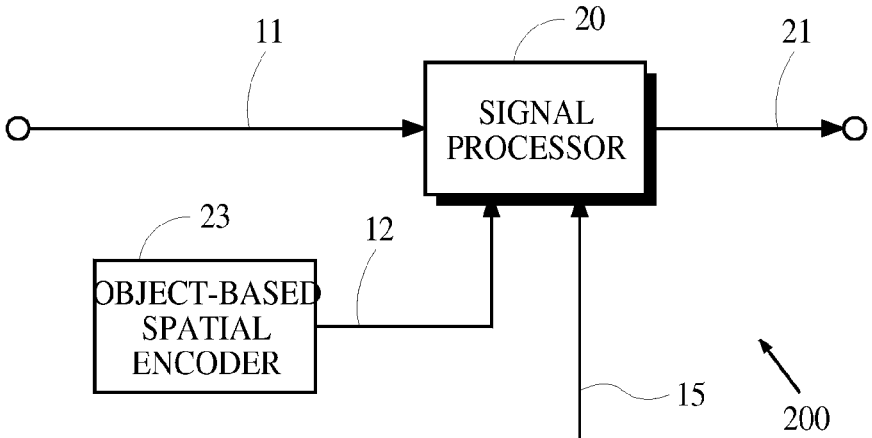
FIG. 2 is a schematic block diagram of an exemplary implementation of a device with a signal processor that implements various aspects of the present invention.

FIG. 2 is a schematic block diagram of an exemplary implementation of a device 200 that incorporates the signal processor 20. In this implementation, the device 200 includes an object-based spatial encoder 23 that generates along the path 12 the supplementary encoded signal described above. The supplementary audio objects represented by the encoded data in this supplementary encoded signal may be real-world sources of audio content such as vocal utterances captured by a microphone or they may be synthesized audio elements such as audio signals generated by a computer in response to button presses or selections of options by a computer input device. These examples of supplementary audio objects are pertinent to applications that combine live or user-generated audio content with the principal encoded signal so that both principal audio objects and supplementary audio objects can be represented by the soundfield generated by the acoustic output transducers connected to the decoding receiver 30. Essentially any type of audio object may be represented by encoded data in the supplementary encoded signal.

In another exemplary implementation, the object-based spatial encoder 23 may be omitted because the audio content and spatial location of the supplementary audio objects are either synthesized directly as needed or they are recorded and retrieved as needed. Details of implementation for the object-based spatial encoder 23 are not discussed further because these details are not needed to understand how to implement and carry out the present invention.

As mentioned above, the signal processor 20 may adapt its operation in response to the control signal received from the communication path 15. For example, the signal processor 20 may adaptively control which principal audio objects and which supplementary audio objects are represented by encoded data in the encoded output signal. In other words, the signal processor 20 can effectively control the addition and deletion of audio objects in the encoded output signal.

As another example, the signal processor 20 may modify audio content or spatial location for one or more audio objects in the encoded output signal. Modification to audio content may include any type of audio processing that may be desired such as changing signal level, modifying spectral shape, adding reverberation or injecting noise. Changes in location may be accomplished by modifying metadata accompanying the audio content that represent spatial location.

If either the principal encoded signal or the supplementary encoded signal include encoded data representing the composite audio content for a group of audio objects and metadata with mixing gain coefficients for use in rendering the composite audio content at playback, the signal processor 20 may adapt one or more of the mixing gain coefficients that are assembled into the encoded output signal. This type of adaptation can be used to control the relative loudness of audio objects in the group, including the effective removal of one or more audio objects in the group from the soundfield generated at playback.

C. Encoded Signal Processing

FIGS. 3 to 6 are schematic illustrations of encoded signals that help explain three methods that may be used to process encoded signals according to various aspects of the present invention. These three methods may be referred to generally as appending, replacing and inserting audio objects. The first method of "appending" generates the encoded output signal by adding encoded data from the supplementary encoded signal to the encoded data from the principal encoded signal. The second and third methods of "replacing" and "inserting" generate the encoded output signal by modifying existing sections within the principal encoded signal to include encoded data from the supplementary encoded signal.

The three methods are discussed below using specific details of one coding technique known as Dolby® TrueHD™. Additional details for this coding technique may be obtained from U.S. Pat. No. 6,611,212 entitled "Matrix Improvements to Lossless Encoding and Decoding" published Aug. 26, 2003, from U.S. Pat. No. 6,664,913 entitled "Lossless Coding Method for Waveform Data" published Dec. 16, 2003, and from technical documents such as "Meridian Lossless Packing, Technical Reference for FBA and FBB streams," ver 1.0, October 2005 by Dolby Laboratories, Inc, San Francisco, Calif. Dolby TrueHD is a lossless audio coding technique that can be used to generate encoded signals with encoded data that represent discrete audio content and spatial location of one or more audio objects. Details of this coding technique are not essential to the present invention but are presented only as examples to help explain the three methods of processing encoded signals.

Figure 3:
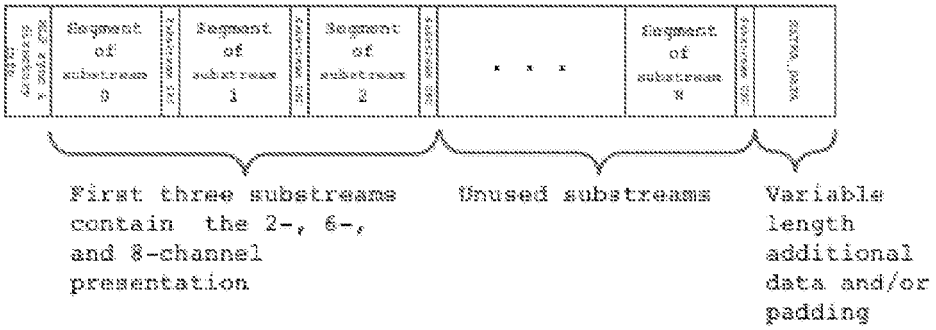
FIGS. 3 to 6 are schematic illustrations of encoded signals that help explain methods that may be used to carry out various aspects of the present invention.

FIG. 3 is a schematic illustration of one segment in a series of segments in an encoded signal that may be generated by the Dolby TrueHD coding technique. The segment shown in the figure is referred to as an "access unit" and contains encoded data representing as many digital samples as are needed to represent audio content for a specified interval of time. A typical interval for many applications is 1/1200 of a second.

An access unit comprises several sections as shown in FIG. 3. The first section includes synchronization codes and control data that specify access unit size and the number and position of encoded-data sections within the access unit that represent audio content. The sections of encoded-data that represent audio content immediately follow the first section.

Each encoded-data section is referred to as a "substream" and carries encoded data representing audio content for one or more audio channels when used in conventional channel-based coding systems. An access unit for Dolby TrueHD may have from one to fifteen substreams but preferred implementations reserve the first three substreams for compatibility with legacy coding systems. As shown in FIG. 3, the first substream referred to as "substream 0" contains encoded data for a 2-channel presentation, the second substream referred to as "substream 1" contains encoded data for a 6-channel presentation, and the third substream referred to as "substream 2" contains encoded data for an 8-channel presentation of the same audio content. If desired, the sections for some substreams need not carry any meaningful data but can serve as placeholders for data to be added to the access unit.

An access unit may also include an optional section that follows all substreams if constraints on access unit size and data rate that may be imposed by a particular application are not violated. This optional section is referred to as the "EXTRA_DATA" section. When present, the EXTRA_DATA section is typically unused but it can be filled with meaningful data if desired.

1. Appending

Figure 4:
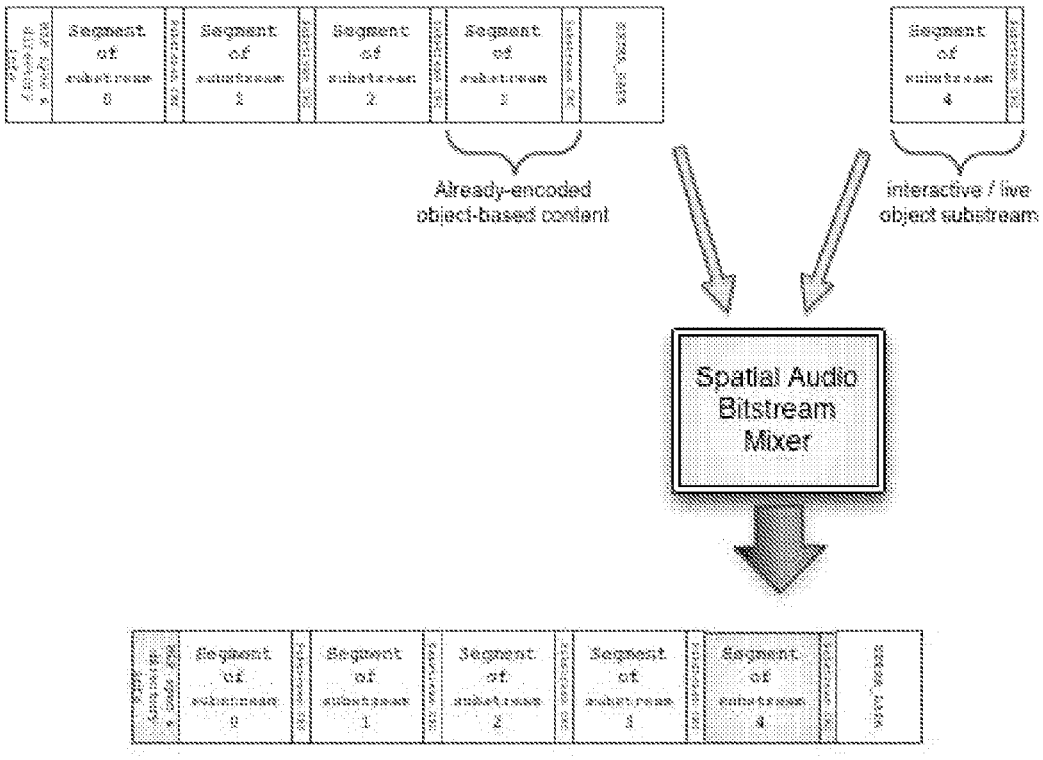

FIG. 4 is a schematic illustration of the method for processing an access unit to append audio objects. In the example shown in the figure, the access unit in the upper-left portion of the drawing represents an access unit in the principal encoded signal with substreams 0 to 2 reserved for legacy-system compatibility as explained above. Substream 3 contains encoded data representing audio content and spatial location of a principal audio object.

The segment in the upper-right portion of the drawing is encoded data from the supplementary encoded signal that represents audio content and spatial location of a supplementary audio object.

According to the first method, the signal processor 20 analyzes the principal encoded signal to identify the first section of an access unit that contains sync words and control data. The signal processor 20 obtains from this control data the access unit size, number and location of substreams from the control data, and expands the access unit to include space for a new substream 4. Data for the supplementary audio object is placed into the new substream. Control data in the first section is updated to reflect the additional substream and larger size of the access unit. The modified access unit is output as an access unit in a Dolby TrueHD compatible encoded output signal.

Encoded data for additional supplementary audio objects may be appended to the encoded signal in a similar manner. The total number of appended objects should not cause the access unit to exceed its maximum allowable size nor cause the number of substreams to exceed their maximum allowable number.

2. Replacing

An application may need to preserve a particular data rate. This generally means the signal processor 20 must generate access units in its encoded output signal that are the same size as the access units in the principal encoded signal. This may require a pre-allocation of space in the principal encoded signal for carrying encoded data for any audio objects to be added. This method may be necessary for coding techniques that do not have a flexible format for its encoded-signal. Fortunately, many coding techniques allow for unused data fields that can be given an arbitrary size. In Dolby TrueHD, for example, such a field is the EXTRA_DATA section described above.

Figure 5:
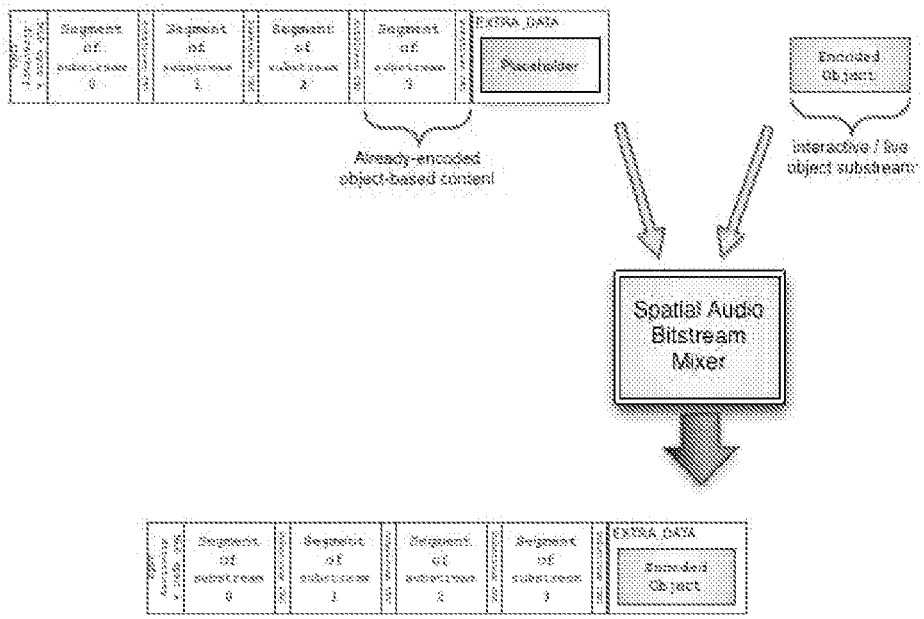

FIG. 5 is a schematic illustration of a method for processing an access unit to replace an unused section of an access unit. In the example shown in the figure, the access unit in the upper-left portion of the drawing represents an access unit in the principal encoded signal with substreams 0 to 2 reserved for legacy-system compatibility as explained above. Substream 3 contains encoded data representing audio content and spatial location of a principal audio object. The EXTRA_DATA section of the access unit represents the pre-allocated space discussed above. The size of the EXTRA_DATA section must be large enough to carry the encoded data for the supplementary object plus any additional control data needed to process this encoded information.

The segment shown in the upper-right portion of the drawing is encoded data from the supplementary encoded signal that represents audio content and spatial location of a supplementary audio object.

According to the second method, the signal processor 20 analyzes the principal encoded signal to identify the first section of an access unit that contains sync words and control data. The signal processor 20 obtains from this control data the access unit size, location and length of the EXTRA_DATA section. Data for the supplementary audio object is placed into the EXTRA_DATA section along with any control data needed to identify the supplementary audio object and to indicate encoded data for the audio object is present.

The control data in the first section of the access unit does not need to be modified because the size of the access unit and the number and location of the substreams is not changed. Furthermore, the encoded data for the supplementary audio object that is added to the EXTRA_DATA section can be encoded in a format that is best suited for the application and need not match the encoding format of the principal encoded data. For example, if the principal encoded data is encoded according to the Dolby TrueHD format, the supplementary encoded data may be encoded according to a different format such as those that are compliant with Dolby Digital®, Dolby Digital® Plus™ or any other suitable lossy or lossless audio coding techniques. Additional details for Dolby Digital and Dolby Digital Plus, which are also known as AC-3 and Enhanced AC-3, respectively, may be obtained from Document A/52:2012, "ATSC Standard: Digital Audio Compression (AC-3, E-AC-3)," published 23 Mar. 2012 by the Advanced Television Systems Committee, Inc, Washington, D.C. In a gaming application, for example, low latency is very important so encoding techniques may be used that reduce latency and/or encoding formats that may be processed with lower latencies may be used. The only constraints imposed by Dolby TrueHD is that the encoded data for the supplementary audio object and any associated control data must fit within the pre-allocated space, and the resulting encoded data must not contain any pattern of bits that mimic the sync words in the first section of the access unit.

Encoded data for additional supplementary audio objects may be added but the number of supplementary objects that may be added is limited by the largest permitted size of the EXTRA_DATA section. This limitation is not significant for many applications that require no more than one or two additional audio objects.

If desired, the encoded data in a substream for one principal audio object may be replaced by the encoded data for a supplementary audio object. This can be done without changing the location of substreams or the size of the access unit.

In yet another implementation, one or more unused substreams can be pre-allocated in access units and used by the signal processor 20 to store encoded data for additional audio objects. This approach is similar to that explained for the EXTRA_DATA section but it differs in a few respects. The main differences are that encoded data placed into a substream must comply with Dolby TrueHD coding standards and some control data must be provided in the access unit to indicate which substreams are actually used for audio objects. The EXTRA-DATA section could be used to carry this control data. The total number of added objects should not cause the access unit to exceed its maximum allowable size nor cause the number of substreams to exceed their maximum allowable number.

3. Inserting

For applications that do not require preserving data rate or access unit size, space for adding an audio object does not need to be pre-allocated if the access unit has one or more sections that can vary in length, provided those sections can be expanded enough to store all of the encoded data and associated control data that is needed to represent the audio object.

Figure 6:
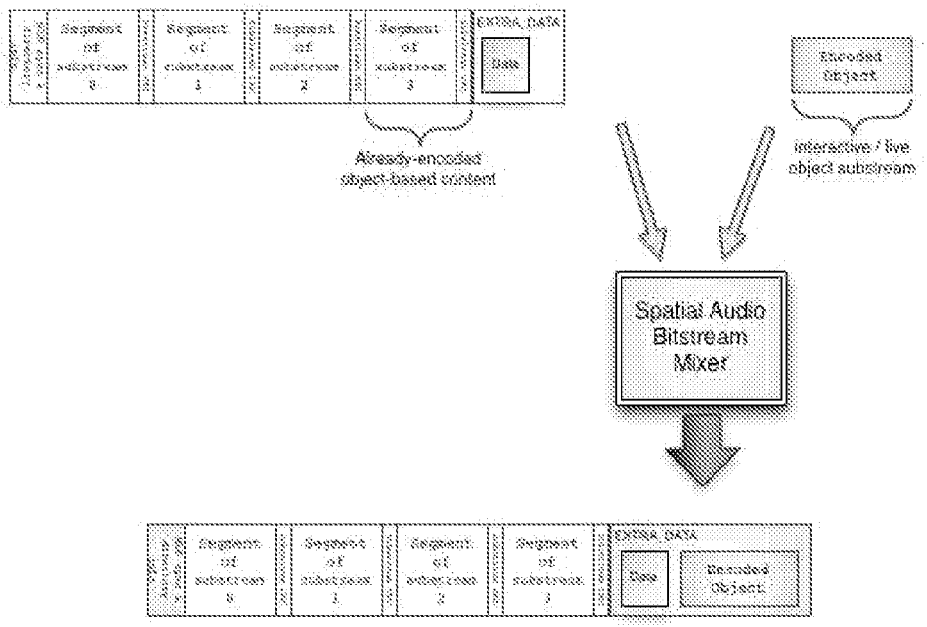

FIG. 6 is a schematic illustration of a method for processing an access unit to store data for an audio object in a variable-length section. In the example shown in the figure, the access unit in the upper-left portion of the drawing represents an access unit in the principal encoded signal with substreams 0 to 2 reserved for legacy-system compatibility as explained above. Substream 3 contains encoded data representing audio content and spatial location of a principal audio object. The EXTRA_DATA section of the access unit is the variable-length section discussed above. The maximum permitted size of the EXTRA_DATA section must be at least large enough to carry the encoded data for the supplementary object plus any additional control data needed to process this encoded information.

The segment shown in the upper-right portion of the drawing is encoded data from the supplementary encoded signal that represents audio content and spatial location of a supplementary audio object.

According to the third method, the signal processor 20 analyzes the principal encoded signal to identify the first section of an access unit that contains sync words and control data. The signal processor 20 obtains from this control data the access unit size, location and length of the EXTRA_DATA section. If the current size of the EXTRA_DATA section is not large enough, it is expanded as needed and data for the supplementary audio object is placed into the EXTRA_DATA section along with any control data needed to identify the supplementary audio object and to indicate encoded data for the audio object is present.

If the EXTRA_DATA section already contains other data as shown in the drawings, the size of the EXTRA_DATA section and the location of the encoded data for the supplementary audio object should be adjusted to preserve this other data.

The control data in the first section of the access unit should be modified as needed to reflect any change in the EXTRA_DATA section, which in turn affects the size of the access unit.

As explained above, encoded data for one or more supplementary audio objects that are added to the EXTRA_DATA section can be encoded in a format that is best suited for their application, subject to constraints imposed by Dolby TrueHD that the encoded data for the supplementary audio objects and any associated control data must fit within the space permitted, and that the resulting encoded data must not contain any pattern of bits that mimic the sync words in the first section of the access unit.

The number of supplementary objects that may be added is limited by the largest permitted size of the EXTRA_DATA section; however, this limitation is not significant for many applications that require no more than one or two additional audio objects.

D. Implementation

Figure 7:
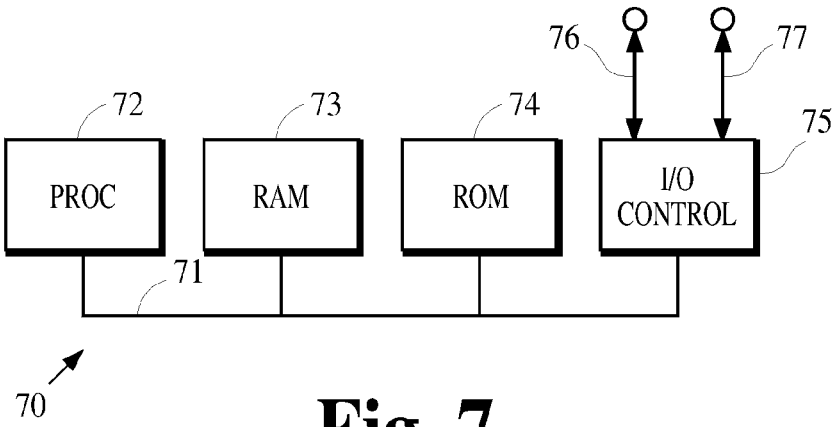
FIG. 7 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 7 is a schematic block diagram of a device 70 that may be used to implement aspects of the present invention. The processor 72 provides computing resources. RAM 73 is system random access memory (RAM) used by the processor 72 for processing. ROM 74 represents some form of persistent storage such as read only memory (ROM) for storing programs needed to operate the device 70 and possibly for carrying out various aspects of the present invention. I/O control 75 represents interface circuitry to receive and transmit signals by way of the communication channels 76, 77. In the embodiment shown, all major system components connect to the bus 71, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device 78 having a storage medium such as magnetic tape or disk, or an optical medium. The storage medium may be used to record programs of instructions for operating systems, utilities and applications, and may include programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, and non-transitory media that stores information using essentially any recording technology including magnetic tape, cards or disk, optical cards or disc, and detectable markings on media including paper.

The invention claimed is:

1. A method for generating an encoded audio output signal, wherein the method comprises:

receiving a principal encoded signal encoded in the Dolby TrueHD format, the principal encoded signal including encoded data representing discrete audio content and spatial location for each of one or more principal audio objects;

receiving a supplementary encoded signal that includes encoded data representing discrete audio content and spatial location for each of one or more supplementary audio objects; and assembling the encoded data from the principal encoded signal with the encoded data from the supplementary encoded signal to generate the encoded audio output signal, wherein said assembling comprises either:

adding the encoded data from the supplementary encoded signal to the encoded data from the principal encoded signal, including by identifying an access unit of the principal encoded signal, expanding the access unit to include space for a new substream in the principal encoded signal and placing the encoded data from the supplementary encoded signal into the new substream; or modifying the principal encoded signal to include the encoded data from the supplementary encoded signal, including by using control data of the principal encoded signal to locate an existing section of the principal encoded signal, the existing section being of a size large enough to accommodate the encoded data from the supplementary encoded signal, and by placing the encoded data from the supplementary encoded signal into the existing section; or modifying the principal encoded signal to include the encoded data from the supplementary encoded signal, including by using control data of the principal encoded signal to locate and determine the size of an existing section of the principal encoded signal, by determining whether the size of the existing section is large enough to accommodate the encoded data from the supplementary encoded signal, by expanding the existing section if it is not large enough to accommodate the encoded data from the supplementary encoded signal, and by placing the encoded data from the supplementary encoded signal into the existing section.

2. The method of claim 1, further comprising:

receiving an input audio signal representing the audio content of the one or more supplementary audio objects; and applying an object-based spatial encoder to the input signal to generate the supplementary encoded signal.

3. The method of claim 1, wherein the method adapts which principal audio objects or which supplementary audio objects are represented by encoded data in the encoded output signal, and wherein the method further comprises:

receiving a control signal; and adapting in response to the control signal which encoded data from the principal encoded signal is combined into the encoded output signal or which encoded data from the supplementary encoded signal is combined into the encoded output signal.

4. The method of claim 1, wherein either the principal encoded signal or the supplementary encoded signal includes encoded data representing composite audio content for a group of audio objects and metadata with mixing gain coefficients for use in rendering the composite audio content at playback, and wherein the method further comprises:

receiving a control signal; and adapting in response to the control signal the mixing gain coefficients that are assembled into the encoded output signal.

5. The method of claim 1, further comprising:

receiving a control signal; and modifying in response to the control signal the discrete audio content or the spatial location of a principal audio object or a supplementary audio object that is assembled into the encoded output signal.

6. The method of claim 1, further comprising determining that said existing section already contains other data, wherein said expanding the existing section comprises increasing the size of the existing section so as to preserve said other data already contained in said existing section after said encoded data from the supplementary encoded signal is placed in the existing section, and wherein said placing the encoded data from the supplementary encoded signal into the existing section comprises adjusting a placement location of said encoded data so as to preserve said other data already contained in said existing section after said encoded data is placed in the existing section.

7. An apparatus for generating an encoded output signal, wherein the apparatus comprises one or more processors configured to:

receive a principal encoded signal encoded in the Dolby TrueHD format, the principal encoded signal including encoded data representing discrete audio content and spatial location for each of one or more principal audio objects;

receive a supplementary encoded signal that includes encoded data representing discrete audio content and spatial location for each of one or more supplementary audio objects; and assemble the encoded data from the principal encoded signal with the encoded data from the supplementary encoded signal to generate the encoded audio output signal, wherein assembling the encoded data comprises either:

adding the encoded data from the supplementary encoded signal to the encoded data from the principal encoded signal, including by identifying an access unit of the principal encoded signal, expanding the access unit to include space for a new substream in the principal encoded signal and placing the encoded data from the supplementary encoded signal into the new substream; or modifying the principal encoded signal to include the encoded data from the supplementary encoded signal, including by using control data of the principal encoded signal to locate an existing section of the principal encoded signal, the existing section being of a size large enough to accommodate the encoded data from the supplementary encoded signal, and by placing the encoded data from the supplementary encoded signal into the existing section; or modifying the principal encoded signal to include the encoded data from the supplementary encoded signal, including by using control data of the principal encoded signal to locate and determine the size of an existing section of the principal encoded signal, by determining whether the size of the existing section is large enough to accommodate the encoded data from the supplementary encoded signal, by expanding the existing section if it is not large enough to accommodate the encoded data from the supplementary encoded signal, and by placing the encoded data from the supplementary encoded signal into the existing section.

8. The apparatus of claim 7, wherein the one or more processors are further configured to:

receive an input audio signal representing the audio content of the one or more supplementary audio objects; and apply an object-based spatial encoder to the input signal to generate the supplementary encoded signal.

9. The apparatus of claim 7, wherein the apparatus adapts which principal audio objects or which supplementary audio objects are represented by encoded data in the encoded output signal, and wherein the one or more processors are further configured to:

receive a control signal; and adapt in response to the control signal which encoded data from the principal encoded signal is combined into the encoded output signal or which encoded data from the supplementary encoded signal is combined into the encoded output signal.

10. The apparatus of claim 7, wherein either the principal encoded signal or the supplementary encoded signal includes encoded data representing composite audio content for a group of audio objects and metadata with mixing gain coefficients for use in rendering the composite audio content at playback, and wherein the one or more processors are further configured to:

receive a control signal; and adapt in response to the control signal the mixing gain coefficients that are assembled into the encoded output signal.

11. The apparatus of claim 7, wherein the one or more processors are further configured to:

receive a control signal; and modify in response to the control signal the discrete audio content or the spatial location of a principal audio object or a supplementary audio object that is assembled into the encoded output signal.

12. The apparatus of claim 7, wherein the one or more processors are further configured to determine that said existing section already contains other data, wherein said expanding the existing section comprises increasing the size of the existing section so as to preserve said other data already contained in said existing section after said encoded data from the supplementary encoded signal is placed in the existing section, and wherein said placing the encoded data from the supplementary encoded signal into the existing section comprises adjusting a placement location of said encoded data so as to preserve said other data already contained in said existing section after said encoded data is placed in the existing section.

13. The apparatus of claim 1, wherein the supplementary encoded signal is encoded according to the Dolby TrueHD format, or a lossy or lossless audio coding technique other than the Dolby TrueHD format.

14. A non-transitory medium recording a program of instructions that is executable by a device to perform a method for generating an encoded audio output signal, wherein the method comprises:

receiving a principal encoded signal encoded in the Dolby TrueHD format, the principal encoded signal including encoded data representing discrete audio content and spatial location for each of one or more principal audio objects;

receiving a supplementary encoded signal that includes encoded data representing discrete audio content and spatial location for each of one or more supplementary audio objects; and assembling the encoded data from the principal encoded signal with the encoded data from the supplementary encoded signal to generate the encoded audio output signal, wherein said assembling comprises either:

adding the encoded data from the supplementary encoded signal to the encoded data from the principal encoded signal, including by identifying an access unit of the principal encoded signal, expanding the access unit to include space for a new substream in the principal encoded signal and placing the encoded data from the supplementary encoded signal into the new substream; or modifying the principal encoded signal to include the encoded data from the supplementary encoded signal, including by using control data of the principal encoded signal to locate an existing section of the principal encoded signal, the existing section being of a size large enough to accommodate the encoded data from the supplementary encoded signal, and by placing the encoded data from the supplementary encoded signal into the existing section; or modifying the principal encoded signal to include the encoded data from the supplementary encoded signal, including by using control data of the principal encoded signal to locate and determine the size of an existing section of the principal encoded signal, by determining whether the size of the existing section is large enough to accommodate the encoded data from the supplementary encoded signal, by expanding the existing section if it is not large enough to accommodate the encoded data from the supplementary encoded signal, and by placing the encoded data from the supplementary encoded signal into the existing section.

15. The medium of claim 14, wherein the method further comprises:

receiving an input audio signal representing the audio content of the one or more supplementary audio objects; and applying an object-based spatial encoder to the input signal to generate the supplementary encoded signal.

16. The medium of claim 14, wherein the method adapts which principal audio objects or which supplementary audio objects are represented by encoded data in the encoded output signal, and wherein the method further comprises:

receiving a control signal; and adapting in response to the control signal which encoded data from the principal encoded signal is combined into the encoded output signal or which encoded data from the supplementary encoded signal is combined into the encoded output signal.

17. The medium of claim 14, wherein either the principal encoded signal or the supplementary encoded signal includes encoded data representing composite audio content for a group of audio objects and metadata with mixing gain coefficients for use in rendering the composite audio content at playback, and wherein the method further comprises:

receiving a control signal; and adapting in response to the control signal the mixing gain coefficients that are assembled into the encoded output signal.

18. The medium of claim 14, wherein the method further comprises:

receiving a control signal; and modifying in response to the control signal the discrete audio content or the spatial location of a principal audio object or a supplementary audio object that is assembled into the encoded output signal.

19. The medium of claim 14, wherein the method further comprises determining that said existing section already contains other data, wherein said expanding the existing section comprises increasing the size of the existing section so as to preserve said other data already contained in said existing section after said encoded data from the supplementary encoded signal is placed in the existing section, and wherein said placing the encoded data from the supplementary encoded signal into the existing section comprises adjusting a placement location of said encoded data so as to preserve said other data already contained in said existing section after said encoded data is placed in the existing section.

20. The medium of claim 14, wherein the supplementary encoded signal is encoded according to the Dolby TrueHD format, or using a lossy or lossless audio coding technique other than the Dolby TrueHD format.

* * * * *